US005247708A

United States Patent [19]

Freese, Jr.

[11] Patent Number: 5,247,708

[45] Date of Patent: Sep. 28, 1993

[54] FIREFIGHTER PANTS

[75] Inventor: George E. Freese, Jr., Pittsfield, N.H.

[73] Assignee: Globe Manufacturing Company, Pittsfield, N.H.

[21] Appl. No.: 929,957

[22] Filed: Aug. 17, 1992

[51] Int. Cl.[5] ..... A41D 13/00

[52] U.S. Cl. ..... 2/79; 2/81; 2/227

[58] Field of Search ..... 2/79, 81, 82, 227, 229, 2/243 B, 243 R

[56] References Cited

U.S. PATENT DOCUMENTS

| | | | |
|---|---|---|---|
| 1,099,875 | 6/1914 | Fuiks | 2/227 |
| 1,285,444 | 11/1918 | Sollen | 2/79 |
| 1,823,458 | 9/1931 | Mayer | 2/227 |
| 2,020,155 | 11/1935 | Molter | 2/79 |
| 2,679,647 | 6/1954 | Gossner | 2/82 |
| 4,117,552 | 10/1978 | Simpson | 2/79 |
| 4,146,933 | 4/1979 | Jenkins | 2/79 |
| 4,509,213 | 4/1985 | Harvey | 2/227 |
| 4,922,552 | 5/1990 | Grillion | 2/81 |
| 5,031,242 | 7/1991 | Aldridge | 2/81 |
| 5,072,454 | 12/1991 | Trahan | 2/79 |
| 5,115,518 | 5/1992 | Hofman | 2/227 |

*Primary Examiner*—Clifford D. Crowder
*Assistant Examiner*—Diana L. Biefeld
*Attorney, Agent, or Firm*—Watson, Cole, Grindle & Watson

[57] ABSTRACT

Each pant leg of a pair of firefighter pants is formed of a front section and a back section each of which is of one-piece construction. Both the inseam edge and the outseam edge of the front section of each pant leg bulge outwardly only at the knee portion and along only a minor portion of the edges to provide additional space at the knee portion of each pant leg.

9 Claims, 3 Drawing Sheets

FIREFIGHTER PANTS

BACKGROUND OF THE INVENTION

The present invention relates to firefighter pants and more particularly to a novel construction at the knee portion of each pant leg to afford greater freedom of movement when the firefighter flexes his knees.

Firefighters perform many challenging duties when fighting fires which require bending of the knees. For example, they climb ladders and are often called upon to bend over and sometimes crawl from one place to another. Such activities are very difficult if there is any tendency for the pants to bind at the knees. This problem is compounded due to the fact that firefighter pants include an outer shell which is fire-resistant and water-resistant plus a detachable inner liner including a moisture barrier layer and a heat-resistant layer. This construction is quite bulky and heavy and restricts movement of the firefighter.

Since the knee areas are continually flexed while fighting fires, it is important to provide increased freedom of movement of the knees of the firefighter. It is noted that conventional means of providing increased flexibility of the knee portions of garments such as folds as shown in U.S. Pat. No. 1,099,875, tucks as shown in U.S. Pat. No. 4,117,552 or accordion pleats as shown in U.S. Pat. No. 4,509,213 are not suitable for use in firefighter pants since these constructions are liable to be caught and torn by objects encountered while fighting a fire. If the pants are torn, the integrity of the pants is destroyed and the firefighter is not adequately protected. Therefore, such prior art constructions are not suitable for use in firefighter pants.

U.S. Pat. No. 5,031,242 discloses an arrangement wherein a pair of firefighter pants is provided with a separate generally elliptically shaped bellows at the knee portion of each pant leg, extra material being provided in a direction parallel with the long dimension of the pant leg to provide extra space for the knee of a firefighter. U.S. Pat. No. 5,072,454 discloses a separate insert which is attached over a rectangular opening with extra material being provided in a direction parallel with the long dimension of the pant leg.

The disclosures of the latter two patents are incorporated herein by reference in their entirety. These two patents disclose constructions which require extra pieces of material and more stitching, thereby resulting in a more bulky and expensive construction. Furthermore, there is a greater possibility of leakage at the knee portion of the moisture barrier included in the liner of the pants.

It is therefore a principle objective of the invention to provide increased freedom of movement at the knee portions of firefighter pants in a simple and inexpensive manner to provide a less bulky construction requiring less stitching and eliminating the necessity of providing extra inserts while further ensuring that there is no leakage at the seams of the moisture barrier of the liner.

SUMMARY OF THE INVENTION

The present invention accomplishes the desired results in a most simple and effective manner. Each pant leg includes a front section and a back section, each section having an inseam edge and an outseam edge. Each front section has a knee portion which receives the knee of a firefighter. In order to provide greater freedom of movement, the inseam and outseam edge of the front section of each pant leg bulges outwardly at the knee portion to provide extra material in a direction generally perpendicular to the long dimension of the pant leg, thereby providing additional space at the knee portion to afford greater freedom of movement of a firefighter's knees.

The front section of each pant leg is of one-piece construction and the inseam edge and outseam edge of each front section are spaced from one another a greater distance at the knee portion than the spacing between the inseam edge and outseam edge immediately above and below the knee portion.

With this construction, the desired freedom of movement is obtained without requiring the use of additional pieces of material or inserts, and the bulk and amount of stitching as well as the cost of manufacture are minimized. Furthermore, since no insert or extra seams are provided in the moisture barrier of the liner, an effective moisture seal is ensured.

DESCRIPTION OF THE PREFERRED EMBODIMENT

Figure 1:
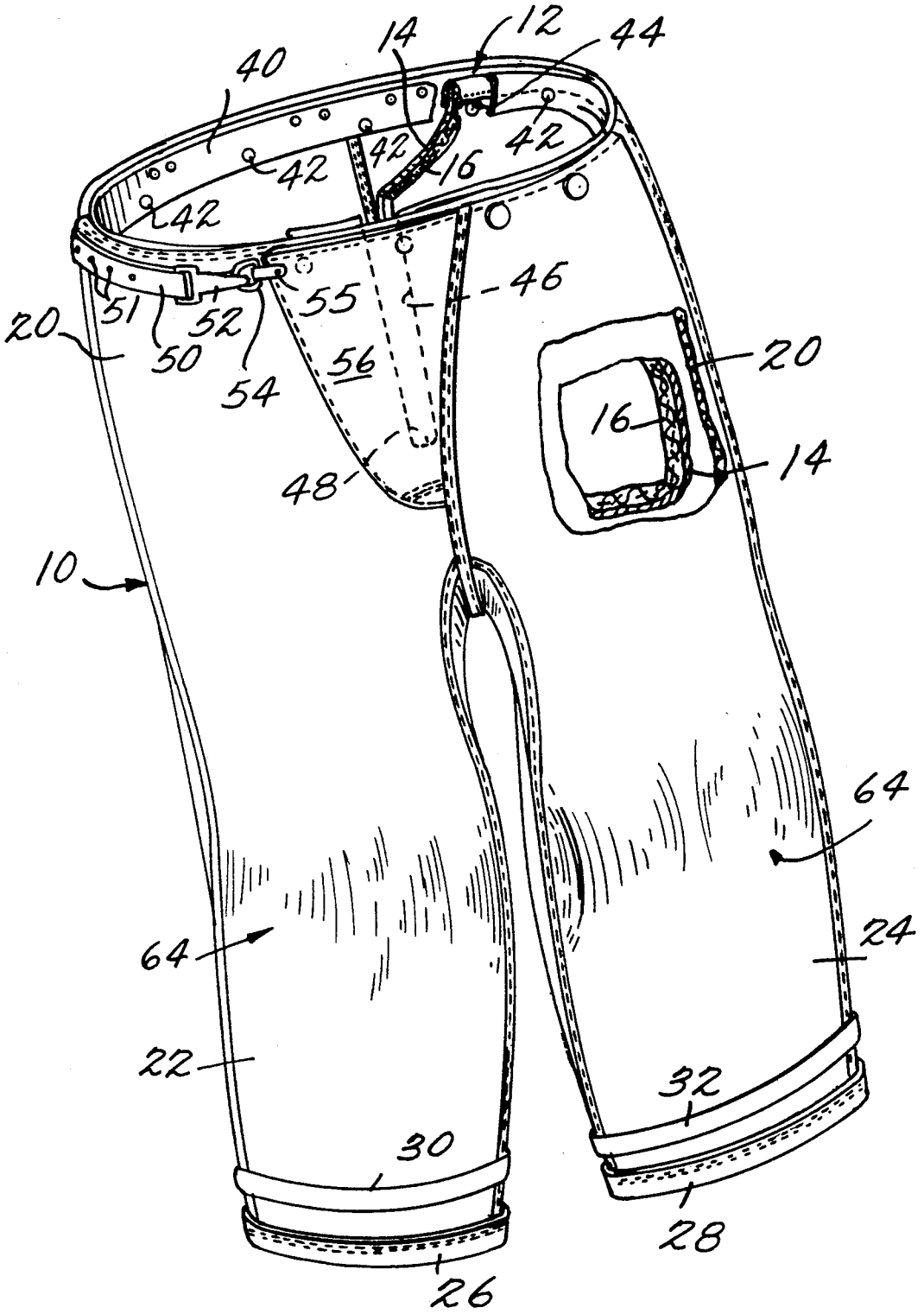
FIG. 1 is a top perspective view partly broken away of a pair of firefighter pants according to the invention.

Referring now to the drawings wherein like reference characters designate corresponding parts throughout the several views, there is shown in in FIG. 1 a pair of firefighter pants according to the invention. The pants include an outer shell and a detachable liner designated generally by reference numerals 10 and 12 respectively. The inner liner includes an outer moisture barrier layer 14 which is stitched to an inner heat insulating layer 16.

The shell may be made, for example, of an aramid fabric sold under the tradename NOMEX by E. I. du-Pont de Nemours & Co., Wilmington, Del., U.S.A. which is fire-resistant and has been treated or coated with a water repellent finish such as neoprene to provide water-resistance. The outer vapor barrier layer of the liner may be made, for example, of a neoprene coated cotton material. The inner heat insulating layer may be made, for example, of a quilt formed of NOMEX aramid fibers. Other equivalent materials may be employed for the shell and liner as is well-known in the art.

The outer shell and the liner each include a torso-covering portion 20 and a pair of full length pants legs 22 and 24 each having a long dimension extending from the top to the bottom of the leg and including suede cuffs 26 and 28 stitched to the lower ends thereof to provide abrasion resistance. Light reflective horizontal bands 30 and 32 are stitched to each pant leg and may be, for example, formed of SCOTCHLITE material sold by 3-M Corp., Minneapolis, Minn., U.S.A.

An independent waistband 40 extends around the inner surface of the shell at the upper end thereof, the upper edge of the waistband being stitched to the shell, while the lower edge of the waistband is free. The lower edge portion of the waistband is provided with a plurality of spaced snap fasteners 42, the fastening portions of which face the outer shell. The upper edge portion of the liner is provided with a corresponding number of spaced snap fasteners 44 one of which is visible in FIG. 1. The fastening portions of snap fasteners 44 face inwardly of the liner and engage the fastening portions of fasteners 42 to support the liner within the shell. The liner is attached under the waistband to avoid snagging when donning the pants and may be readily detached from the shell when desired.

As can be seen in dotted line 46 in FIG. 1, the front of the liner is provided with a downwardly extending narrow opening 46 which terminates at point 48 disposed a short distance above the crotch of the liner.

The shell is connected with a leather strap 50 by rivets 51 which is connected to a clip 52 adapted to engage a fitting 54 connected by rivets 55 with a fly piece 56 more fully described hereinafter.

Figure 2:
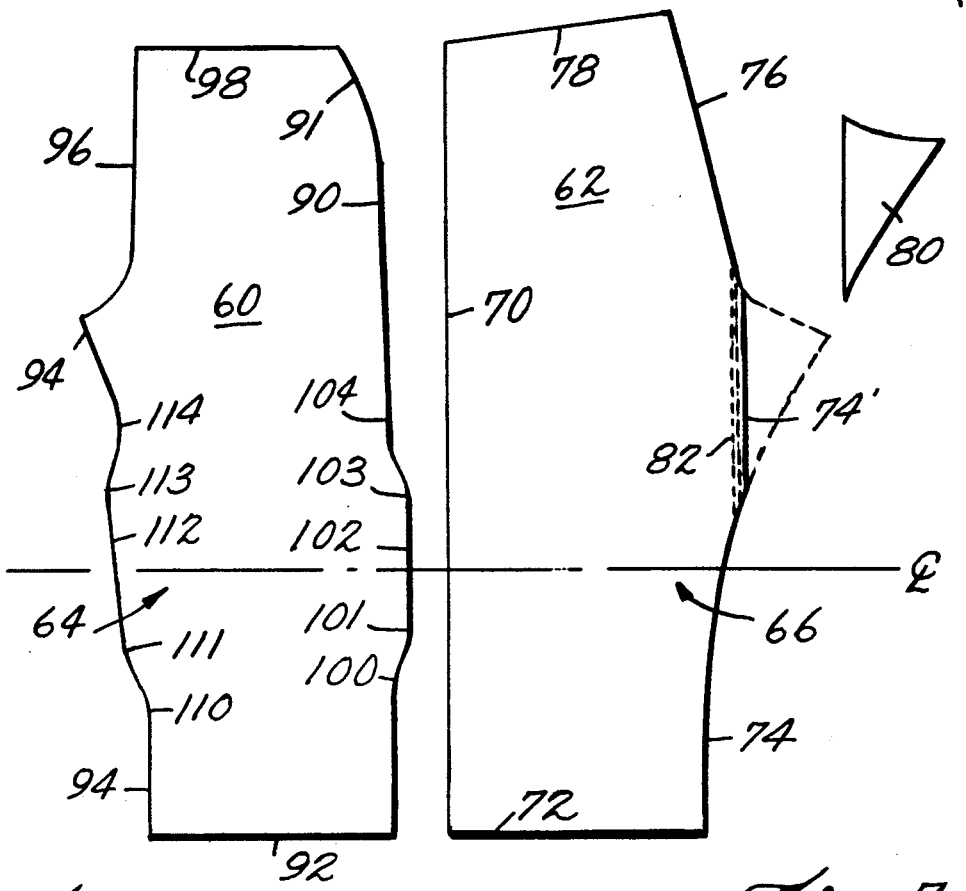
FIG. 2 is an exploded view illustrating the front and back sections and a gusset of each pant leg.

Referring now to FIG. 2, the construction of components of the shell of each pant leg are illustrated. It will be understood that the construction of the two pants legs are substantially mirror images of one another, and accordingly, a description of one pant leg will suffice, like reference characters being provided for similar components of each pant leg. Each pant leg includes a front section 60 and a back section 62, these sections having knee portions 64 and 66 extending equally above and below a center knee line designated by reference character CL on the drawing. The center knee line represents the normal location of a firefighter's knees when the pants are worn. It is noted that each of the front and back sections is one one-piece construction.

Back section 62 is of substantially conventional configuration and includes an outseam edge 70, a hem edge 72, an inseam edge 74, a back rise edge 76 and a waist line edge 78. A conventional gusset 80 is provided as shown in solid lines. As indicated in dotted lines, gusset 80 is adapted to be sewn to the straight line portion 74' of the inseam edge along a double line of stitching 82.

The front section 60 has an outseam edge 90 including a tapered hip portion edge 91, a hem edge 92, an inseam edge 94, a front rise edge 96 and a waist line edge 98. The outseam edge 90 slopes outwardly from a point 100 remote from and below the center knee line to a point 101 closer to and below but spaced from the center knee line. The outseam edge then continues along a substantially straight line portion 102 to a point 103 spaced from and above the center knee line whence it slopes inwardly to a point 104 more remote from the center knee line.

In a similar manner, the inseam edge 94 of the front section slopes outwardly from a point 110 remote from and below the center knee line to a point 111 closer to and below but spaced from the center knee line. The inseam edge then continues along a substantially straight line portion 112 to a point 113 spaced from and above the center knee line whence it slopes inwardly to a point 114 more remote from the center knee line.

In a typical example, the distance between points 100 and 104 as well as points 110 and 114 may be about twelve inches. The distance between points 101 and 103 as well as points 111 and 113 may be about nine inches. The inseam and outseam edges protrude outwardly at the center knee line about one inch on each edge compared to the usual inseam and outseam edges so that the width of the knee portions at the center knee line of the front section is about two inches greater than that of a conventional front section. This extra material causes the knee portions to be slightly domed outwardly, thereby providing the desired increase in freedom of movement of a firefighter's knees. It is noted that the sewing distance along the inseam and outseam edges is increased as compared to conventional constructions in order to accommodate the protruding inseam and outseam edges.

It is therefore apparent that the inseam edge and the outseam edge of the front section of each pant leg bulges outwardly at the knee portion to provide extra material in a direction generally perpendicular to the long dimension of the pant leg to provide additional space at the knee portion when the front and back sections are connected to one another.

The components of the liner incorporate the same novel construction at the knee portions thereof as discussed in connection with the shell above. The components of the liner including the front and back sections as well as the gussets have substantially the same configuration as those of the shell with the exception of the front fly portions thereof. Therefore, the liner incorporates the same novel knee construction described in connection with the shell components so that the liner also provides the desired degree of freedom of movement of a firefighter's knees.

Figure 3:
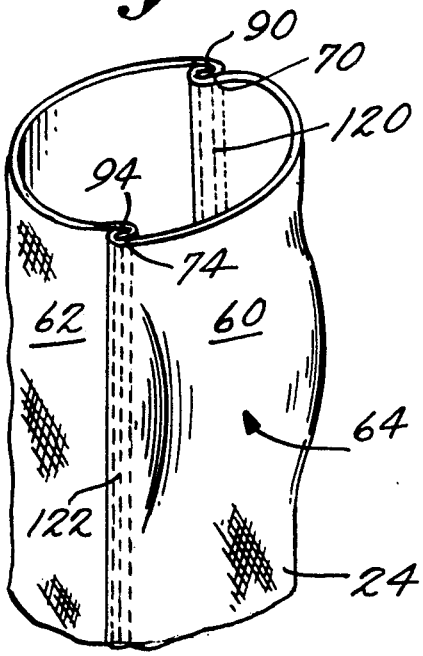
FIG. 3 is a top perspective view of a portion of one pant leg.
Figure 4:
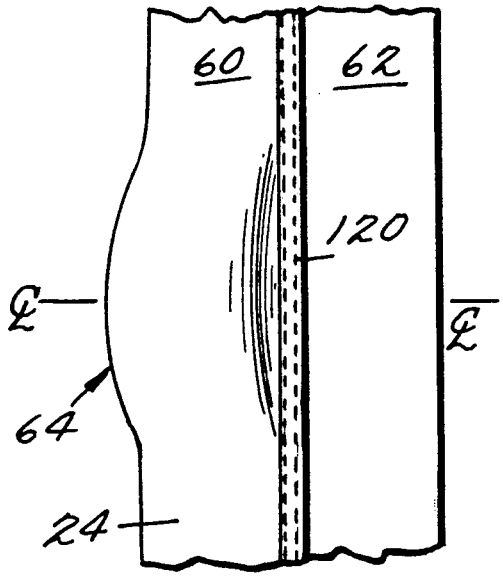
FIG. 4 is a side view of a portion of one pant leg.

Referring to FIGS. 3 and 4, the outseam edges 70 and 90 of the back and front sections 62 and 60 respectively are connected to one another by a double line of stitching 120, while the inseam edges 74 and 94 of the back and front sections 62 and 60 are connected to one another by a double line of stitching 122. The extra material provided at the knee portions 64 in these figures is clearly seen, thereby providing extra space at the knee portions for the firefighter's knees.

Figure 5:
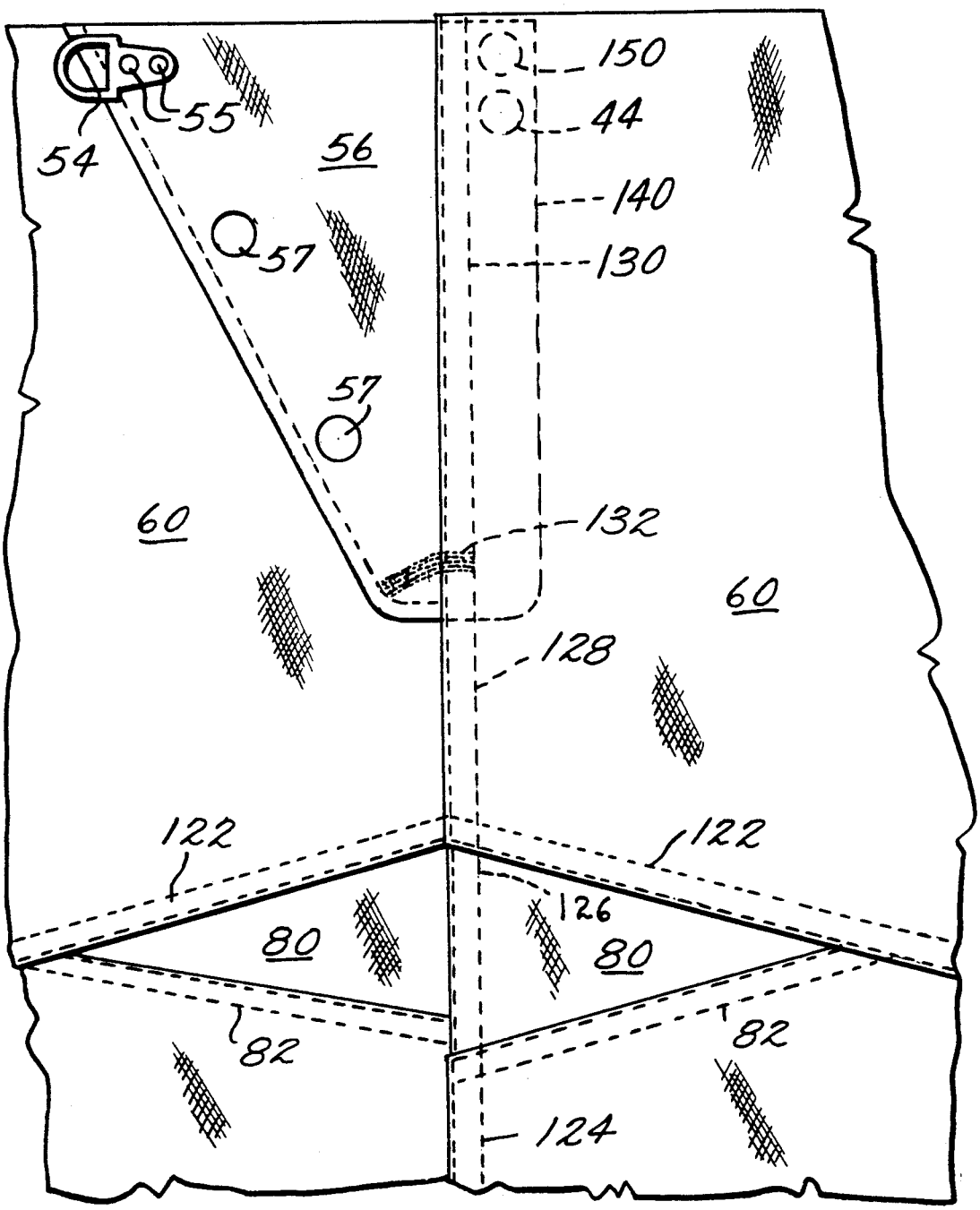
FIG. 5 is an enlarged view showing the crotch and fly areas of the pants.

As seen in FIG. 5, a double line of stitching 124 connects the back rise edges of the back sections of the two pant legs to one another. A double line of stitching 126 connects the two gussets to one another. A double line of stitching 128 connects the lower parts of the front rise edges to one another.

The fly piece 56 is of generally triangular configuration and is connected to the right hand front section 60 as seen in FIG. 5 by a double line of stitching 130. The lower end of fly piece 56 is connected to the left hand front section 60 by stitching 132 about which the fly piece 56 is adapted to be folded. A second fly piece 140 seen in dotted lines in FIG. 5 is of generally rectangular configuration and is connected along its left hand edge to the left hand front section 60 by a double line of stitching (not shown).

Fly piece 56 is provided with snap fasteners 57 the fastening portions of which cooperate with complementary snap fasteners secured to the left hand front section 60 to retain the fly piece in position. A snap fastener 150 shown in dotted lines is secured to fly piece 140 and cooperates with a complementary snap fastener secured to waistband 40 previously described.

The invention has been described with reference to a preferred embodiment. Obviously, modifications, alterations and other embodiments will occur to others upon reading and understanding this specification. It is my intention to include all such modifications, alterations and alternate embodiments insofar as they come within the scope of the appended claims or the equivalent thereof.

What is claimed is:

1. A pair of firefighter pants comprising, a pair of full length pants legs each having a long dimension extending from the top to the bottom of the leg, each pant leg including a front section and a back section, each of said sections being of one-piece construction and having an inseam edge and an outseam edge, each front section having a knee portion for receiving the knee of a firefighter, the inseam edge and the outseam edge of the front section of each pant leg bulging outwardly at said knee portion in a direction generally perpendicular to the long dimension of the pant leg to define a bulge only at said knee portion extending in the direction of said long dimension only a minor portion of said long dimension to provide additional space at said knee portion, the inseam edge and the outseam edge of the front and back sections of each pant leg being connected to one another.

2. A pair of firefighter pants as defined in claim 1 wherein said pair of pants includes an outer shell and a liner, the knee portions of both the outer shell and liner being of similar construction.

3. A pair of firefighter pants as defined in claim 2 wherein said liner is removably connected to said shell, said liner including an outer moisture barrier layer and an inner heat insulating layer.

4. A pair of firefighter pants comprising a pair of full length pants legs each having a flexible knee portion for receiving the knee of a firefighter, each pant leg having a long dimension extending from the top to the bottom of the leg, said flexible knee portion extending in the direction of said long dimension only a minor portion of said long dimension, each pant leg including a front section and a back section connected to one another, each of said sections being of one-piece construction and having an inseam edge and an outseam edge, the inseam edge and outseam edge of the front section of each pant leg being spaced from one another along the surface of the front section a greater distance at said knee portion than the spacing between the inseam edge and the outseam edge of the front section along the surface of the front section immediately above and below said knee portion, said inseam and outseam edges of said front section below said knee portion being disposed substantially parallel with one another.

5. A pair of firefighter pants as defined in claim 4 wherein said pair of pants includes a torso-covering portion, said pair of pants including an outer shell and a liner, said liner having a pair of full length pants legs, each pant leg of the liner including a front section and a back section, each of said sections of said liner having an inseam edge and an outseam edge, each front section of the liner having a knee portion, both the outer shell and the liner having knee portions of similar construction to provide additional space at said knee portions.

6. A pair of firefighter pants as defined in claim 5 wherein said liner is removably connected to said shell, said liner including an outer moisture barrier layer and an inner heat insulating layer.

7. A pair of firefighter pants comprising, a pair of full length pants legs, each pant leg including a front section and a back section, each of said sections having an inseam edge and an outseam edge, the outseam edge of said back section being substantially linear, each front section having a knee portion including a center knee line where the knee of a firefighter is normally placed, the inseam edge and the outseam edge of the front section of each pant leg sloping outwardly from a point remote from and below said center knee line to a point closer to and below but spaced from said center knee line and further sloping inwardly from a point spaced from and above said center knee line to a point above and more remote from said center knee line to provide extra material at said knee portion to facilitate flexing of the knee of a firefighter, each pant leg having a long dimension extending from the top to the bottom of the leg, the distance between said remote points above and below said center knee line on said inseam edge and said outseam edge being only a minor portion of said long dimension, and said inseam and said outseam edges of said front section below said points remote from and below said center knee line on said inseam edge and said outseam edge being substantially parallel with one another.

8. A pair of firefighter pants as defined in claim 7 wherein each of said front and back sections is of one-piece construction.

9. A pair of firefighter pants as defined in claim 7 wherein said pair of pants includes an outer shell and a liner each having knee portions, said liner including an outer moisture barrier layer and an inner heat insulating layer, said shell, moisture barrier layer and heat insulating layer each having one-piece front sections having an inseam edge and an outseam edge, both the outer shell and the liner having knee portions of similar construction to provide additional space at said knee portions.

* * * * *